United States Patent [19]

Raymond

[11] Patent Number: 5,029,373

[45] Date of Patent: Jul. 9, 1991

[54] CREMATION VASE

[76] Inventor: Rosaire Raymond, 731 Principale, Cowansville, Canada, J2K 1J8

[21] Appl. No.: 598,007

[22] Filed: Oct. 11, 1990

[51] Int. Cl.[5] ..... A61G 17/08

[52] U.S. Cl. ..... 27/1

[58] Field of Search ..... 27/1, 7, 8, 19; 220/410; 428/38; D99/5

[56] References Cited

U.S. PATENT DOCUMENTS

| | | | |
|---|---|---|---|
| D. 85,087 | 9/1931 | Clark . | |
| 232,782 | 9/1880 | Townsend | 27/1 |
| 2,009,724 | 3/1935 | Bircher . | |
| 2,235,617 | 3/1941 | Klinzing | 27/1 |
| 2,513,951 | 7/1950 | McClellen | 27/1 |
| 2,562,726 | 7/1951 | MacDonaldd et al. | 27/1 |
| 3,167,844 | 2/1965 | Bachofner . | |
| 4,199,848 | 4/1980 | Kohnert . | |
| 4,324,026 | 4/1982 | Craft . | |
| 4,648,162 | 3/1987 | Daino | 27/1 |

*Primary Examiner*—Richard E. Chilcot, Jr.
*Attorney, Agent, or Firm*—Robic

[57] ABSTRACT

A cremation vase that has the form of a splendid flower vase. It comprises a tubular body defining the lower portion of the vase and a neck merging into the uppermost portion of the tubular body. The tubular body has an inner top portion and a sealable inner cover in recess at the lowermost portion of the tubulr body and thereby the tubular body defines a first compartment. The neck is narrow at its uppermost portion and is bulging throughout its lowermost portion to merge into the uppermost portion of the tubular body, as to define a continuous exterior wall from the top of the neck to the lowermost portion of the tubular body. The neck provides an open compartment separated from the first compartment.

12 Claims, 2 Drawing Sheets

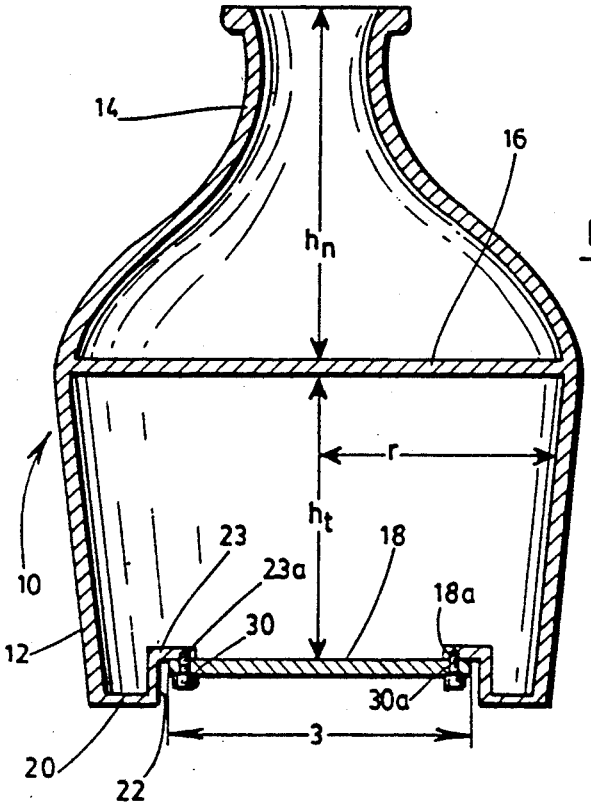
FIG. 2
FIG. 4
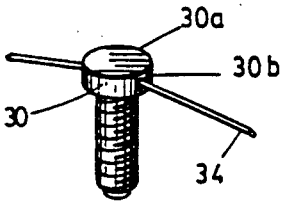
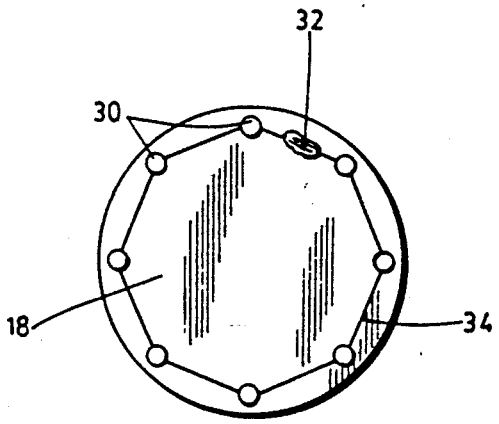
FIG. 3

CREMATION VASE

BACKGROUND OF THE INVENTION

1. Field of the Invention

This invention is directed to cremation vases and to the method of making the same. This invention is particularly directed to a lively cremation vase having the form of a splendid flower recipient.

2. Description of Related Art

Cremation urns are well known and have been described for instance in U.S. Pat. No. 2,009,724, dated July 30, 1935, as invented by BIRCHER, for a receptacle comprising 2 parts having abutting edges, the edges being grooved to receive a sealing strip; U.S. Pat. No. 3,167,844, dated Feb. 2, 1965, as invented by BACHOFNER and U.S. Pat. No. 4,199,848, dated April 29, 1980, as invented by KOHNERT, both directed to book urns; U.S. Pat. No. 4,324,026, dated Apr. 13, 1982, as invented by CRAFT, directed to urns comprising a drawer; and U.S. design 85,087 of Sept. 15, 1931, as invented by CLARK for a combined urn and memorial tablet. At present, the manufacturers of cremation vases produce marble urns, decorated with bronze medallions. All these are sinister urns, bringing a deadly or fatal connotation.

SUMMARY OF THE INVENTION

Broadly stated, Applicant has invented a cremation vase having the form of a splendid flower vase, comprising:

a tubular body defining the lower portion of the vase and a neck merging into the upper portion of said tubular body, said tubular body being provided with a inner top portion to seal said tubular body at its top, and a sealable inner cover in recess, at the lowermost portion of said tubular body, and thereby said tubular body defining a first compartment, said neck being narrow and bulging in the lower portion to merge into the uppermost portion of said tubular body, as to define a continuous exterior wall from the top of the neck to the lowermost portion of said tubular body, said neck providing an open compartment separated from said first compartment.

DESCRIPTION OF THE DRAWINGS

FIG. 2 is a cross-sectional view of the vase shown in FIG. 1 taken along the longitudinal axis, FIG. 3 is a view taken along the line 3—3 of FIG. 2, FIG. 4 is an enlarged view of a bolt taken from FIG. 3.

DESCRIPTION OF A PREFERRED WAY OF CARRYING OUT THE INVENTION

Figure 1:
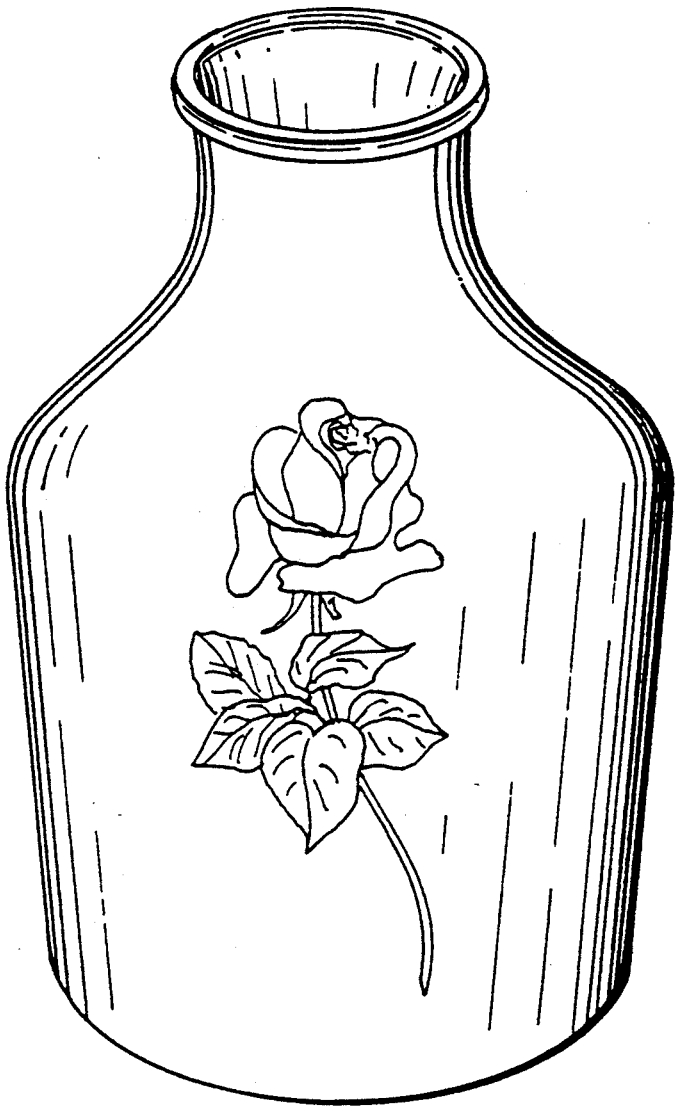
FIG. 1 is a perspective view of a cremation vase illustrating a particular embodiment of the invention.

Referring now to FIG. 2, the cremation vase having the form of a flower recipient 10 comprises a tubular body 12 which defines the lowermost portion of the vase. A neck portion 14 merges into the uppermost portion of the tubular body 12.

The uppermost portion of the tubular body 12 is provided with an inner top portion 16 that seals the tubular body 12 at its top. A sealable cover 18 is positioned in recess at the lowermost portion of the tubular body as will be discussed hereinbelow.

The neck 14 is narrow at its uppermost portion but about halfway its length is bulging throughout its lower portion to finally merge into the uppermost portion of the tubular body 12, as to define a continuous exterior wall from the top of the neck to the lowermost portion of the tubular body.

The bottom of the vase has a wall 20 which defines a bottom and an inner cylindrical wall 22 and flange 23.

The flange 23 is provided with a plurality of threaded holes 23*a* corresponding to a plurality of holes 18*a* in the cover 18 for securing said cover to said flange 23 by bolts 30 and thereby sealing a first compartment defined by the tubular body 12, top portion 16, walls 20, 22, flange 23 and cover 18.

The bolts 30 are preferably provided with a head 30*a* having a horizontal passage 30*b*.

Preferably, the cremation vase has a neck having a height ($h_n$) which is about the same as the height ($h_t$) of the tubular body.

The height ($h_t$) of the tubular body is preferably about of the same dimension as the radius (r) of the tubular body.

The tubular body is preferably shaped as an inverted troncated cone in order to enhance its beauty.

Preferably, the neck is uniformingly bulging in its lower position, thereby the expansion of the neck being uniform.

As can also be seen from FIG. 2, the narrowest portion of the neck runs down about half of the length of the neck and then, the neck expands. Still in a preferred embodiment, the expansion of the neck is uniform and linear.

This cremation vase can be easily manufactured, for instance, by molding bronze.

After the insertion into the tubular body 12, of the ashes of a deceased, generally contained in a plastic bag, the cover 18 can easily be pulled to flange 23 with the bolts 30 in the threaded holes of said flange 23. Preferably, the bolts, better shown in FIG. 4, have a head 30*a* provided with a channel 30*b*, thereby (as shown in FIG. 3 and omitted in FIG. 2 for sake of clarification), a thread 34 of iron can pass through the channel of each bolt, the end of the thread is then sealed in lead 32.

In a preferred embodiment, as shown in FIG. 1, the cremation vase can be provided with a design or pattern molded within the walls of the vase.

The cremation vase being preferably in bronze has another advantage of being engravable with inscriptions as one may wish.

The cover 18 can also be engraved if desired.

Obviously, numerous other modifications can be made to this cremation vase having the form of a splendid flower pot.

Although the present invention has been explained hereinabove by way of preferred embodiments thereof, it should be pointed out that any modifications to these preferred embodiments, within the scope of the appended claims, is not deemed to change or alter the nature and scope of the invention.

What is claimed is:

1. A cremation vase having the form of a splendid flower vase comprising:

a tubular body defining the lower portion of a vase and a neck merging into the uppermost portion of said tubular body, said tubular body being provided with an inner top portion to seal said tubular body at its top, and a sealable inner cover in recess at the lowermost portion of said tubular body and thereby said tubular body defining a first compartment, said neck being narrow at its uppermost portion and bulging throughout its lowermost portion to merge into the uppermost portion of said tubular body, as to define a continuous exterior wall from the top of said neck to the lowermost portion of said tubular body, said neck providing an open compartment separated from said first compartment.

2. The cremation vase as defined in claim 1, wherein the neck and the tubular body have about the same height.

3. The cremation vase as defined in claim 1, wherein the height of the tubular body is about the dimension of the radius of said tubular body.

4. The cremation vase as defined in claim 1, wherein the tubular body is shaped as a troncated cone.

5. The cremation vase as defined in claim 1, wherein the narrowest portion of the neck is about half of the height of the neck, the other half of the length of the neck, said neck expanding to form the bulging portion.

6. The cremation vase as defined in claim 5, wherein the lower half of the height of the neck, the expansion of the neck is uniform.

7. The cremation vase as defined in claim 1, in bronze.

8. The cremation vase as defined in claim 1, being casted.

9. The cremation vase as defined in claim 1, being molded.

10. The cremation vase as defined in claim 1, wherein said inner cover is sealed with a thread of iron and lead.

11. The cremation vase as defined in claim 1, being engraved with an inscription.

12. The cremation vase as defined in claim 1, having a design or pattern molded within the wall of the vase.

* * * * *